US012163700B2

(12) United States Patent
Hjortland

(10) Patent No.: US 12,163,700 B2
(45) Date of Patent: Dec. 10, 2024

(54) ENERGY EFFICIENT HEAT PUMP WITH FLOW REGULATION SYSTEM

(71) Applicant: Johnson Controls Tyco IP Holdings LLP, Milwaukee, WI (US)

(72) Inventor: Andrew Leroy Hjortland, Stoughton, WI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/308,268

(22) Filed: Apr. 27, 2023

(65) Prior Publication Data

US 2023/0349599 A1 Nov. 2, 2023

Related U.S. Application Data

(60) Provisional application No. 63/336,176, filed on Apr. 28, 2022.

(51) Int. Cl.
*F25B 13/00* (2006.01)
*F25B 49/02* (2006.01)

(52) U.S. Cl.
CPC ..... *F25B 13/00* (2013.01); *F25B 49/022* (2013.01); *F25B 2313/02741* (2013.01); *F25B 2313/0292* (2013.01)

(58) Field of Classification Search
CPC ..... F25B 13/00; F25B 49/022; F25B 2313/02741; F25B 2313/0292
See application file for complete search history.

(56) References Cited

U.S. PATENT DOCUMENTS

2002/0073721 A1* 6/2002 Seo ..... F25B 49/022 62/228.3
2011/0000240 A1* 1/2011 Yamada ..... F25B 49/005 62/190

FOREIGN PATENT DOCUMENTS

CN 214250189 A * 9/2021
EP 1614983 A2 * 1/2006 ..... F25B 31/004
JP 2009002576 A * 1/2009

OTHER PUBLICATIONS

Wang et al., Air Conditioning System, Sep. 21, 2021, CN214250189U, Whole Document (Year: 2021).*
Omura et al., Refrigerating Cycle Apparatus, Jan. 8, 2009, JP2009002576A, Whole Document (Year: 2009).*

* cited by examiner

*Primary Examiner* — Jerry-Daryl Fletcher
*Assistant Examiner* — Larry L Furdge
(74) *Attorney, Agent, or Firm* — Fletcher Yoder, P.C.

(57) ABSTRACT

An energy efficient heat pump for a heating, ventilation, and air conditioning (HVAC) system includes a compressor system having a plurality of compressors configured to direct a working fluid along a working fluid circuit of the heat pump, a suction conduit configured to direct the working fluid to the compressor system, a first suction conduit portion extending from the suction conduit to a first compressor of the plurality of compressors, a second suction conduit portion extending from the suction conduit to a second compressor of the plurality of compressors, and a control valve disposed along the suction conduit between the first suction conduit portion and the second suction conduit portion.

20 Claims, 11 Drawing Sheets

ENERGY EFFICIENT HEAT PUMP WITH FLOW REGULATION SYSTEM

CROSS REFERENCE TO RELATED APPLICATIONS

This application claims priority to and the benefit of U.S. Provisional Application No. 63/336,176, entitled "HEAT PUMP SYSTEMS AND METHODS," filed Apr. 28, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems with improved efficiency. More particularly, embodiments of the present disclosure are directed to reducing energy consumption by employing a subcooler and a valve arrangement with multiple compressors configured to operate more efficiently in different operating modes, which limits corresponding emissions.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a working fluid (e.g., refrigerant) between the condenser and the evaporator. In this way, the compressor facilitates heat exchange between the refrigerant, the condenser, and the evaporator. In some cases, refrigerant flow through the refrigerant circuit may be reversible, such that the condenser is operable as an evaporator (e.g., a heat absorber), and the evaporator is operable a condenser (e.g., a heat rejector). Accordingly, the HVAC system may operate as a heat pump system in multiple operating modes (e.g., a cooling mode, a heating mode) to provide both heating and cooling to the building with one refrigeration circuit. Unfortunately, operation of conventional heat pump systems may result in the formation of relatively large pressure differentials across certain components of the heat pump system. Formation of such pressure differentials may increase a power demand (e.g., power consumption) of the compressor used to circulate refrigerant along the refrigerant circuit the heat pump system. Moreover, typical heat pump systems may be ill-equipped to accommodate variations in demand (e.g., heating demand, cooling demand) of the environment (e.g., building, room, space) conditioned by the heat pump system. Therefore, implementation of typical heat pump systems may limit an overall operational efficiency of the HVAC system.

SUMMARY

In one embodiment, an energy efficient heat pump for a heating, ventilation, and air conditioning (HVAC) system includes a compressor system having a plurality of compressors configured to direct a working fluid along a working fluid circuit of the heat pump, a suction conduit configured to direct the working fluid to the compressor system, a first suction conduit portion extending from the suction conduit to a first compressor of the plurality of compressors, a second suction conduit portion extending from the suction conduit to a second compressor of the plurality of compressors, and a control valve disposed along the suction conduit between the first suction conduit portion and the second suction conduit portion.

In another embodiment, an energy efficient heat pump for a heating, ventilation, and air conditioning (HVAC) system includes a working fluid circuit configured to circulate a working fluid therethrough, where the working fluid circuit includes a first heat exchanger configured to exchange heat between the working fluid and a supply air flow, a second heat exchanger configured to exchange heat between the working fluid and an ambient air flow, and an intermediate heat exchanger configured to exchange heat between a first flow of the working fluid and a second flow of the working fluid. The heat pump also includes a flow regulation system having a reversing valve disposed along the working fluid circuit and configured to adjust a flow direction of the working fluid through the working fluid circuit, a first compressor and a second compressor disposed along the working fluid circuit and arranged in a parallel flow arrangement, and a flow control valve disposed along a suction conduit extending between the reversing valve and the intermediate heat exchanger, where the flow control valve is disposed between a first conduit configured to direct the working fluid from the suction conduit to the first compressor and a second conduit configured to direct the working fluid from the suction conduit to the second compressor.

In a further embodiment, an energy efficient heat pump for a heating, ventilation, and air conditioning (HVAC) system includes a working fluid circuit configured to circulate a working fluid and a first compressor and a second compressor disposed along the working fluid circuit and arranged in a parallel flow arrangement, where the first compressor and the second compressor are configured to receive the working fluid via a suction conduit of the working fluid circuit, and where the first compressor includes a first volume index, the second compressor includes a second volume index, and the first volume index and the second volume index are different from one another. The heat pump also includes a flow control valve disposed along the suction conduit between a first suction inlet of the first compressor and a second suction inlet of the second compressor and a controller communicatively coupled to the flow control valve, where the controller is configured to adjust a position of the flow control valve based on a load demand of the heat pump.

DETAILED DESCRIPTION

Figure 1:
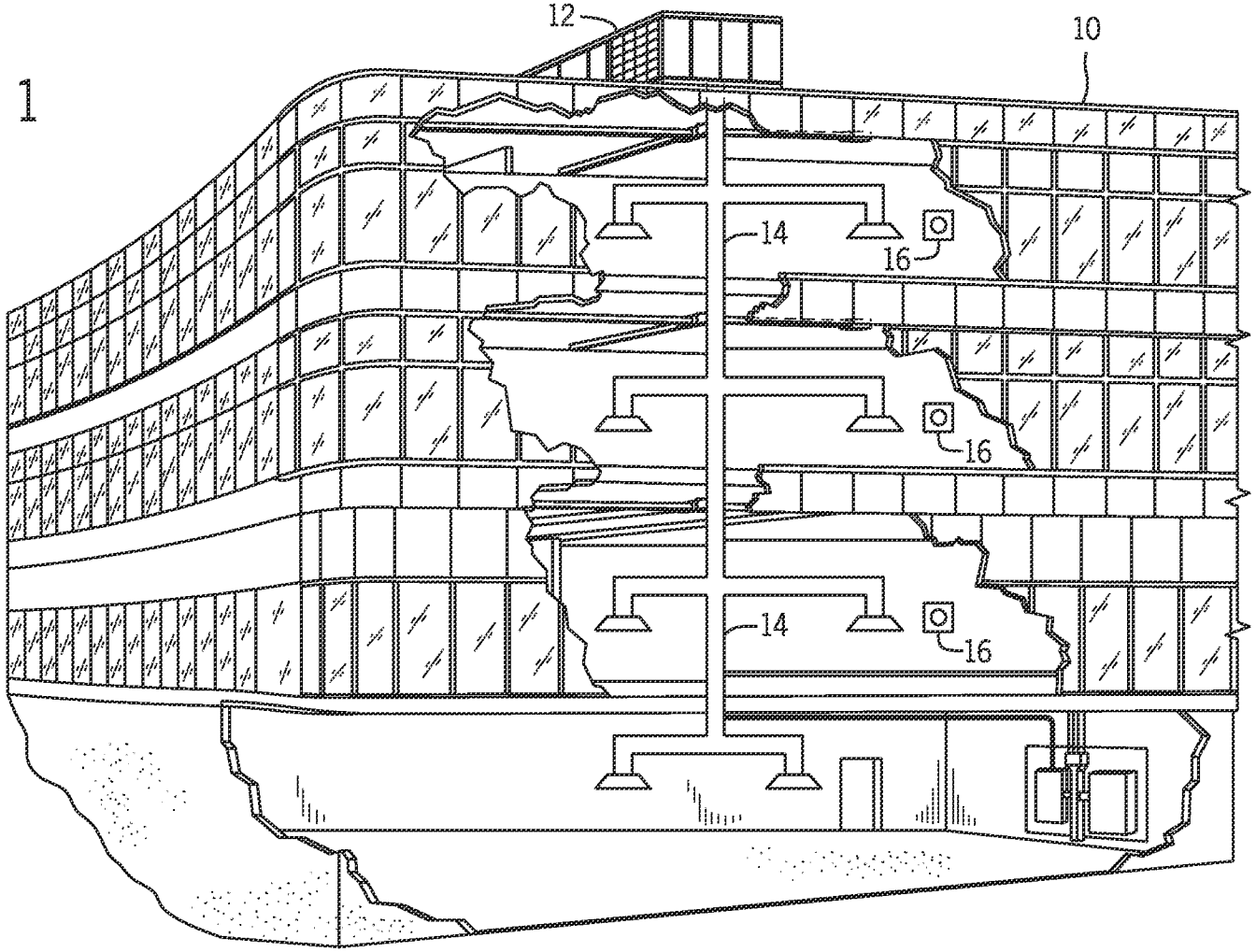
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit (e.g., refrigerant circuit). A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system) having a first heat exchanger (e.g., a heating and/or cooling coil, an indoor coil, the evaporator) positioned within a building and/or the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load (e.g., an air flow to be conditioned) and the ambient environment, for example. The heat pump system is operable to provide both cooling and heating to the space to be conditioned (e.g., a room, zone, or other region within a building) by adjusting a flow of the working fluid through the working fluid circuit. Thus, the heat pump may not include a dedicated heating system, such as a furnace or burner configured to combust a fuel, to enable operation of the HVAC system in the heating mode. As a result, the heat pump operates with reduced greenhouse gas emissions.

For example, during operation of the heat pump system in a cooling mode, the compressor may direct working fluid through the working fluid circuit and the first and second heat exchangers in a first flow direction. While receiving working fluid in the first flow direction, the first heat exchanger (which may operate to condition an air flow supplied to a space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (i.e., a switch-over valve) enables the compressor to direct working fluid through the working fluid circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space, a supply air flow) and, thus, facilitate heating of the thermal load. In this way, the heat pump system may facilitate either heating or cooling of the thermal load based on the current operational mode of the heat pump system (e.g., based on a flow direction of working fluid along the working fluid circuit).

In many cases, pressure differentials or pressure ratios across various components (e.g., a compressor) of the vapor compression system may be relatively large during operation of the heat pump system in certain modes (e.g., heating, cooling), which may increase an overall power demand of the compressor used to drive working fluid flow along the working fluid circuit. Moreover, pressure differentials or pressure ratios across the components or sections of the working fluid circuit may vary based on the mode (e.g., cooling, heating) in which the heat pump system operates and/or a demand of the thermal load serviced by the heat pump system. As an example, pressure ratios across a compressor of the working fluid circuit may be within a first range while the heat pump system operates in the cooling mode and may be within a second (e.g., different) range while the heat pump system operates in the heating mode. In particular, such pressure ratios may be indicative of a differential between an entering working fluid pressure at an inlet of the compressor and a exiting working fluid pressure at an outlet of the compressor. Unfortunately, operating the compressor to generate, maintain, or otherwise sustain relatively large pressure differentials along the working fluid circuit may reduce an overall operational efficiency of the HVAC system due to an elevated power consumption of the compressor. Moreover, typical heat pump systems may be ill-equipped to accommodate variations in the demand (e.g., cooling demand, heating demand) of the thermal load (e.g., low demand, moderate demand, high demand).

Moreover, a volume index (e.g., a volume ratio) of the compressor coupled to the working fluid circuit may be fixed (e.g., invariable), which may cause the compressor to be ill-suited or incapable of adjusting working fluid compression and working fluid circulation along the working fluid circuit in response to the varying pressure differentials that may be encountered between operation in the cooling and heating modes of the heat pump system and/or the varying demands of the thermal load serviced by the heat pump system. For example, a heating load of a heat pump may be greater in a cold climate than in a warm climate, but a cooling load of the heat pump in the same cold climate may be lower. In such applications, the heat pump may include a compressor that operates adequately in a heating mode to satisfy a greater heating demand in the cold climate, but the compressor may operate inefficiently in a cooling mode (e.g., the compressor may cycle on and off more frequently in the cooling mode, which may reduce a useful life of the compressor). As a result, throughout a duration in which the heat pump system operates in either the cooling mode, the heating mode, or both, conventional heat pump systems may have a limited overall operational efficiency.

For at least the foregoing reasons, conventional heat pump system design architectures may limit an overall operational efficiency of the HVAC system throughout a duration in which the heat pump system operates in the cooling mode, the heating mode, or both. As such, it is presently recognized that adjusting heat pump operations (e.g., based on a demand, load, and/or operational mode of the heat pump system) to reduce pressure differentials along the working fluid circuit may mitigate or substantially reduce the aforementioned shortcomings of conventional HVAC systems.

Accordingly, embodiments of the present disclosure relate to a heat pump system having a working fluid flow regulation system configured to adjust compression and/or circulation of working fluid along the working fluid circuit based on one or more operational parameters, modes, and/or characteristics of the heat pump system to enhance or optimize an efficiency of the heat pump system (e.g., improved heat transfer efficiency, reduced energy consumption) in the cooling mode and in the heating mode. Such operational parameters may include an operational mode (e.g., cooling, heating) of the heat pump system, a load or demand of one or more thermal loads serviced by the heat pump system (e.g., a low, moderate, and/or high demand), and/or ambient (e.g., atmospheric) conditions surrounding the heat pump system. In any case, implementation of the disclosed heat pump system may improve the overall operational efficiency of the HVAC system during cooling and heating operations, which enables reduced energy consumption.

For example, the working fluid flow regulation system disclosed herein may include a first compressor and a second compressor that are fluidly coupled to the working fluid circuit (e.g., in a parallel configuration). The first compressor (e.g., one or more compressors) may include operational characteristics (e.g., a volume index or compression ratio, a capacity, a power output rating) that facilitate enhanced operation of the heat pump system during low-load conditions (e.g., operational periods where a cooling demand and/or heating demand of the thermal load is relatively low), while the second compressor (e.g., one or more compressors) may include operational characteristics that facilitate enhanced operation of the heat pump system in higher-load conditions (e.g., operational periods where a cooling and/or heating demand of the thermal load is relatively higher). A control valve (e.g., an electronic pressure regulator [EPR], a modulating valve, a shut-off valve) may be fluidly coupled between the first compressor and the second compressor and be configured to control (e.g., adjust, restrict) working fluid flow to one or both of the compressors. In particular, as discussed in detail herein, the control valve may be operable to selectively enable the first and second compressors to operate at a common suction pressure and/or a common discharge pressure and to operate at different suction pressures and/or common discharge pressures. In this manner, the control valve may enable capacity modulation of the first and second compressors collectively to provide increased efficiency of the compressors (e.g., reduced energy consumption), particularly during high temperature lift conditions (e.g., during cold climate heating operations).

A controller of the heat pump system may be configured to selectively operate the control valve, the first compressor, the second compressor, both the first compressor and the second compressor, and/or one or more additional compressors of the compressor system based on the operational parameters of the heat pump system and the operational characteristics of the compressors in a manner that enhances the overall operational efficiency of the heat pump system. For example, the controller may be configured to operate the first compressor and stay (e.g., block) operation of the second compressor while a heating demand and/or a cooling demand of the thermal load is relatively low. The controller may be configured to operate the second compressor and stay (e.g., block) operation of the first compressor while a heating demand and/or a cooling demand of the thermal load is moderate (e.g., greater than the low heating and/or low cooling demand). Further, the controller may be configured to operate both the first compressor and the second compressor while a heating demand and/or a cooling demand of the thermal load is relatively high (e.g., greater than the moderate heating and/or moderate cooling demand). As such, the controller may selectively operate one or more compressors of the heat pump system in a manner that enables the heat pump system to adequately meet current (e.g., real-time) heating and/or cooling demands of the thermal load, while also operating the compressor or combination of compressors in a manner that enables improved overall performance (e.g., increased efficiency, reduced energy consumption) of the heat pump system.

Indeed, as discussed in detail below, the controller may selectively operate individual compressors, combinations of compressors, and/or additional components (e.g., valves, fans, blowers, etc.) included in the heat pump system in accordance with the presently disclosed techniques. Moreover, it should be understood that one or more of the compressors included in the heat pump system may be fixed speed (e.g., fixed capacity) compressors, multi-stage (e.g., two stage) compressors, and/or variable speed compressors. Further, as discussed herein, the disclosed techniques may be implemented in heat pump systems that include a subcooler heat exchanger and/or other suitable heat pump systems. Moreover, it should be appreciated that the heat pump system disclosed herein may be implemented in air-to-air heat pump applications, air-to-water heat pump applications, and/or water-to-water heat pump applications. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one working fluid circuit configured to operate in different modes. In other embodiments, the HVAC unit 12 may include one or more working fluid circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
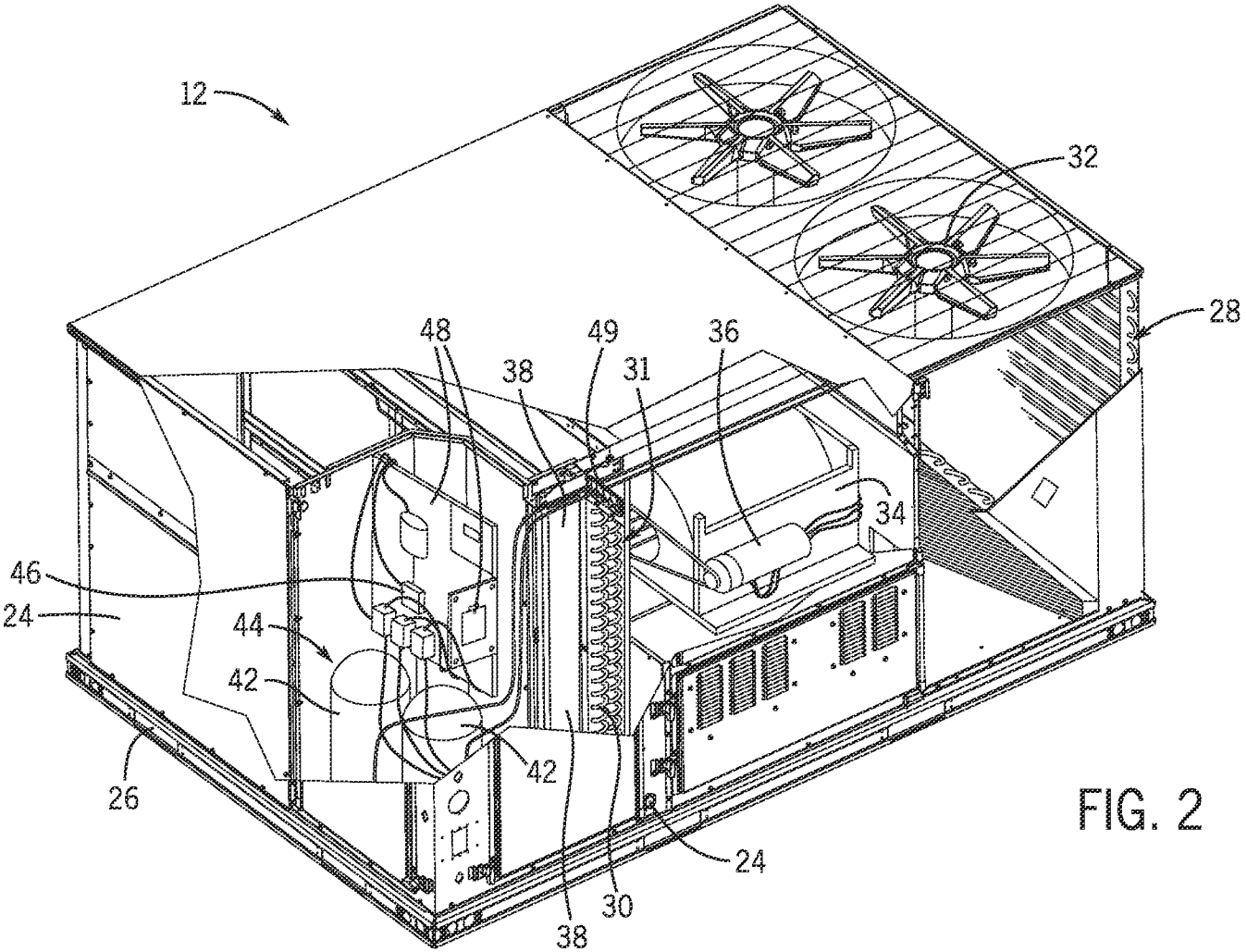
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent working fluid circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more working fluid circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
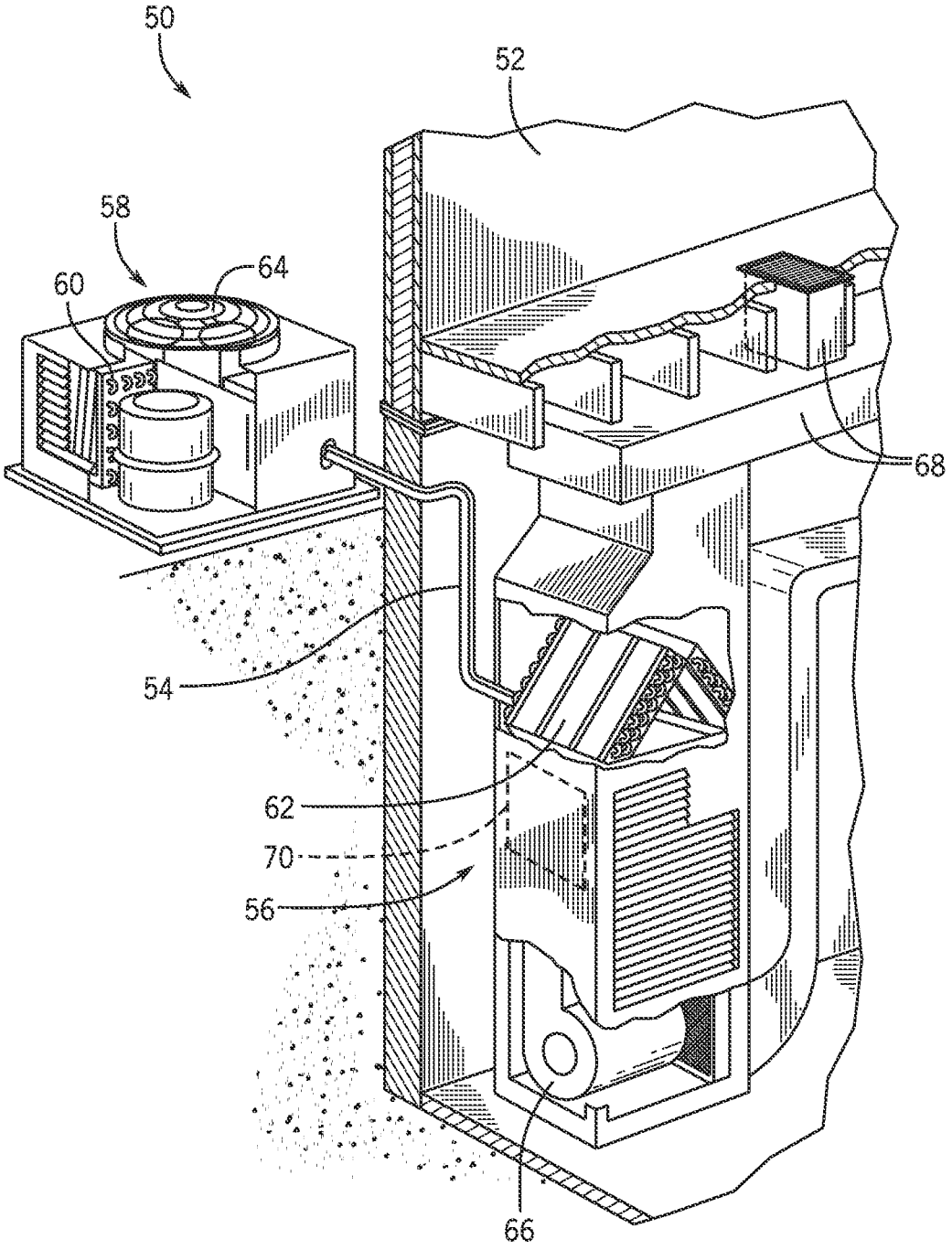
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer refrigerant between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
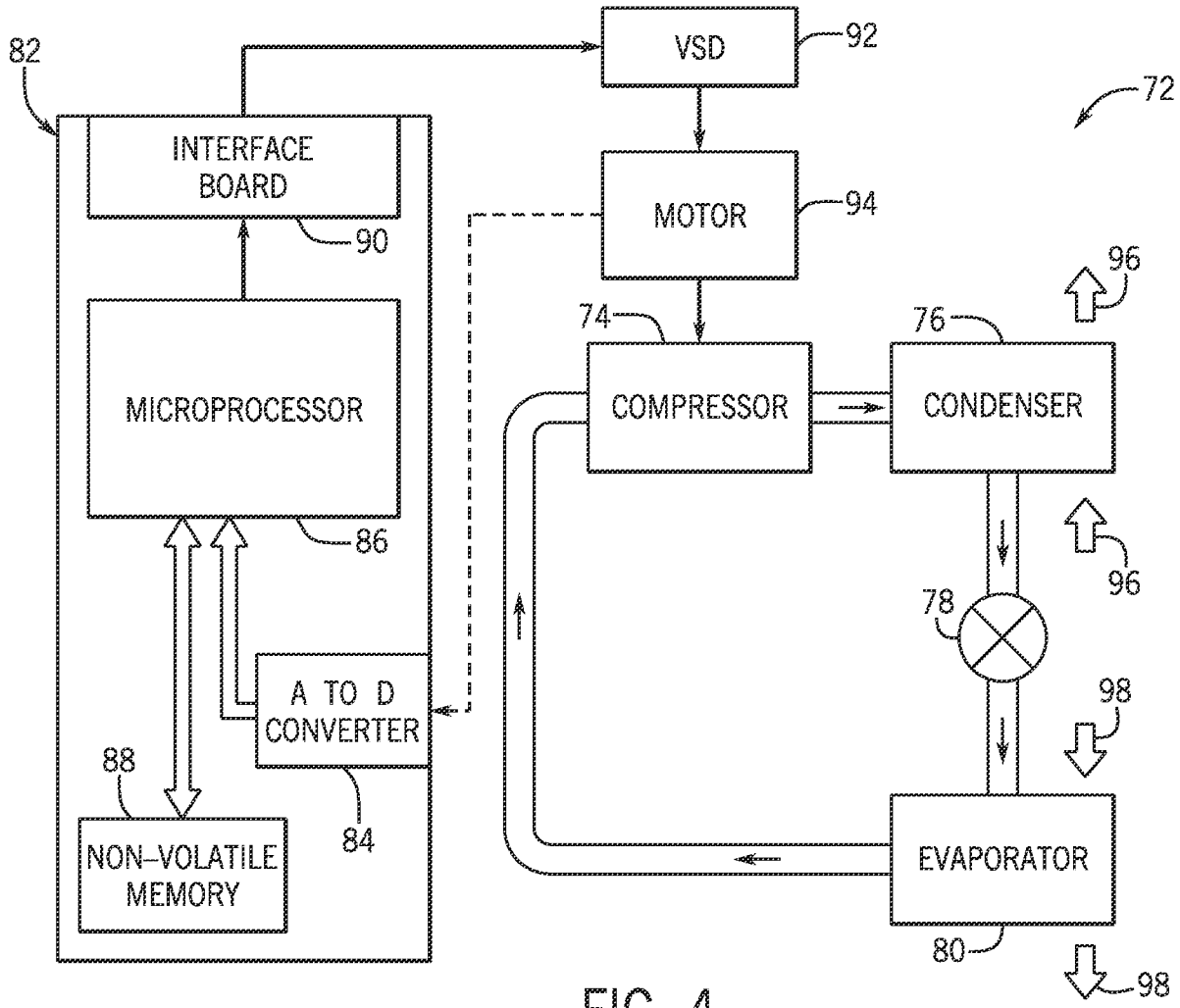
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to an HVAC system having an improved heat pump system. Specifically, embodiments of the present disclosure are directed to an HVAC system having a working fluid flow regulation system configured to adjust compression and/or circulation of working fluid along a working fluid circuit based on one or more operational parameters, modes, and/or characteristics of the heat pump system to enhance or optimize an efficiency of the heat pump system (e.g., improved heat transfer efficiency, reduced energy consumption) in a cooling mode and in a heating mode. For example, the heat pump may include a first compressor and a second compressor having different operational characteristics and configured to operate in different modes to enable more efficient operation of the heat pump (e.g., a central HVAC system) in the heating mode and the cooling mode. The working fluid flow regulation system may also include a control valve configured to control (e.g., adjust, restrict) working fluid flow to one or both of the compressors. A controller may selectively operate one or more compressors of the heat pump in a manner that enables the heat pump to adequately meet current (e.g., real-time) heating and/or cooling demands of a thermal load, while also operating the compressor or combination of compressors in a manner that enables improved overall performance (e.g., increased efficiency, reduced energy consumption) of the heat pump.

Figure 5:
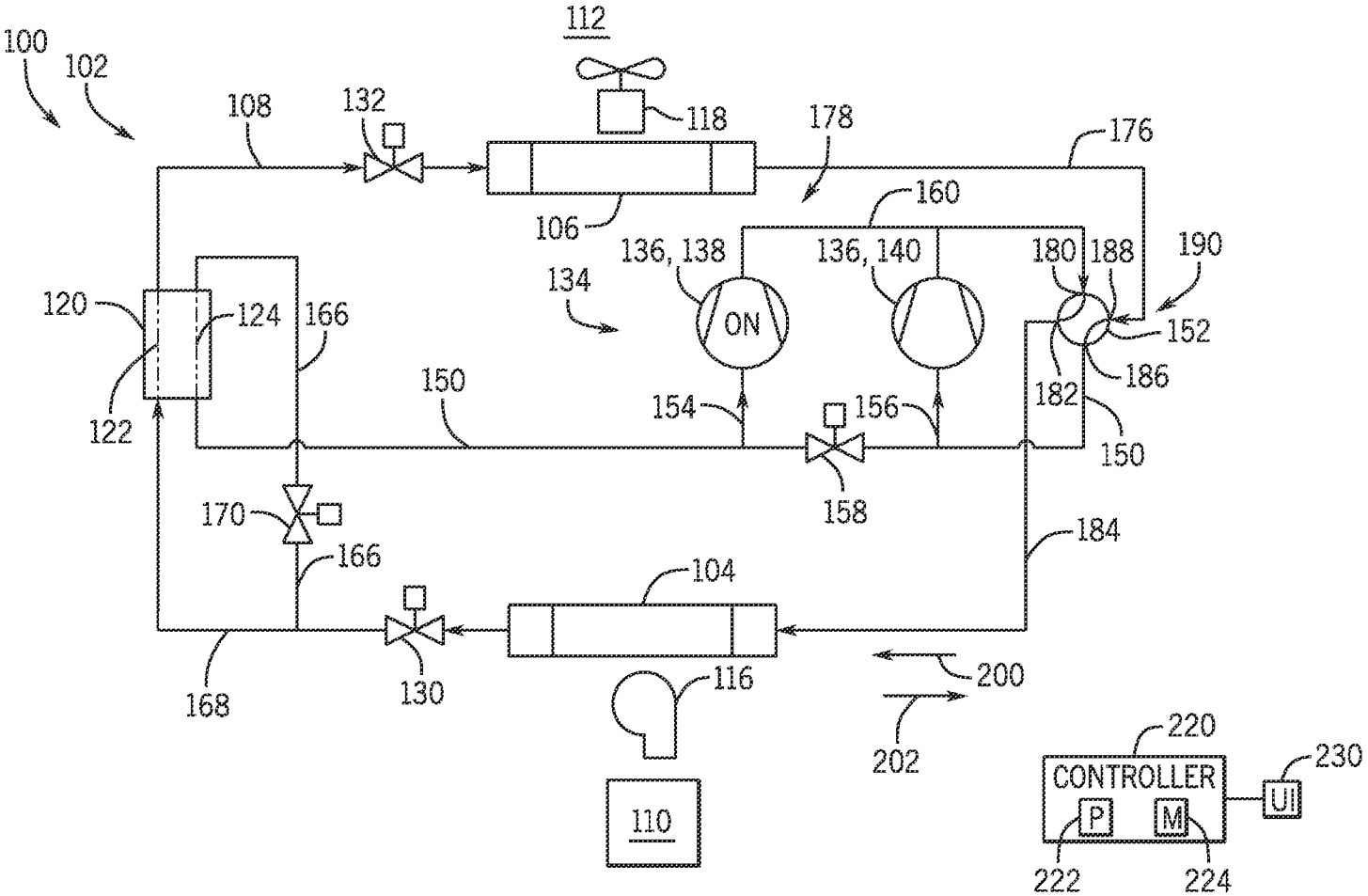
FIG. 5 is a schematic diagram of an embodiment of a portion of an HVAC system that includes a heat pump system configured for operation in a low heating mode, in accordance with an aspect of the present disclosure.

To provide context for the following discussion, FIG. 5 is a schematic of an embodiment of a portion of an HVAC system 100 that includes a heat pump 102 (e.g., a heat pump system, an energy efficient heat pump) in accordance with present embodiments. The heat pump 102 may include one or more components of the vapor compression system 72 discussed above and/or may be included in any of the systems described above (e.g., the HVAC unit 12, the heating and cooling system 50). The heat pump 102 includes a first heat exchanger 104 and a second heat exchanger 106 that are fluidly coupled to one another via a working fluid circuit 108 or working fluid loop (e.g., one or more conduits). The first heat exchanger 104 may be in thermal communication with (e.g., fluidly coupled to) a thermal load 110 (e.g., a room, space, and/or device) serviced by the heat pump 102, and the second heat exchanger 106 may be in thermal communication with an ambient environment 112 (e.g., the atmosphere) surrounding the HVAC system 100.

In some embodiments, a first fan 116 may direct a first air flow across the first heat exchanger 104 to facilitate heat exchange between working fluid within the first heat exchanger 104 and the thermal load 110, while a second fan 118 may direct a second air flow across the second heat exchanger 106 to facilitate heat exchange between working fluid within the second heat exchanger 106 and the ambient environment. A subcooler 120 (e.g., a heat exchanger, an intermediate heat exchanger) is disposed along (e.g., fluidly coupled to) the working fluid circuit 108 between the first heat exchanger 104 and the second heat exchanger 106. The subcooler 120 may include a first flow path 122 (e.g., a first passage, a first coil, a first conduit) and a second flow path 124 (e.g., a second passage, a second coil, a second conduit). As discussed below, the subcooler 120 may facilitate heat exchange between working fluid that may flow through the first flow path 122 and the second flow path 124 during operation of the heat pump 102. As shown in the illustrated embodiment of FIG. 5, the first flow path 122 may form a portion of a flow path (e.g., one or more conduits) that extends along the working fluid circuit 108 between the first heat exchanger 104 and the second heat exchanger 106.

A first expansion valve 130 (e.g., electronic expansion valve, expansion device) may be disposed along the working fluid circuit 108 between the subcooler 120 and the first heat exchanger 104. The first expansion valve 130 may be configured to regulate (e.g., throttle) a working fluid flow and/or a working fluid pressure differential between the first heat exchanger 104 and the subcooler 120 (e.g., the first flow path 122 of the subcooler 120) and/or the second heat exchanger 106. A second expansion valve 132 (e.g., electronic expansion valve, expansion device) may be disposed along the working fluid circuit 108 between the subcooler 120 and the second heat exchanger 106. The second expansion valve 132 may be configured to regulate (e.g., throttle) a working fluid flow and/or a working fluid pressure differential between the second heat exchanger 106 and the subcooler 120 (e.g., the first flow path 122 of the subcooler 120) and/or the first heat exchanger 104.

The heat pump 102 also includes a compressor system 134 disposed along the working fluid circuit 108. The compressor system 134 includes a plurality of compressors 136, such as a first compressor 138 and a second compressor 140, which, as discussed below, are each configured to direct working fluid flow through the first heat exchanger 104, the second heat exchanger 106, and remaining components (e.g., the subcooler 120, the first and second expansion valves 130, 132) that may be fluidly coupled to the working fluid circuit 108. Although the compressor system 134 is shown as having two compressors 136 in the illustrated embodiment, the compressor system 134 may include any suitable quantity of compressors 136, such as three, four, five, six, or more than six compressors 136. In any case, at least a subset of the compressors 136 may be fluidly coupled to one another in a parallel configuration or a parallel flow arrangement (e.g., relative to a flow of working fluid through the compressors 136).

For example, the compressor system 134 may include a suction conduit 150 that extends between the subcooler 120 and a reversing valve 152 (e.g., a switch-over valve) of the heat pump 102. A suction side of the first compressor 138 may be fluidly coupled to the suction conduit 150 via a first suction line 154 (e.g., conduit, first suction conduit portion, first suction inlet), and a suction side of the second compressor 140 may be fluidly coupled to the suction conduit 150 via a second suction line 156 (e.g., conduit, second suction conduit portion, second suction inlet). A first control valve 158 (e.g., an electronic pressure regulator, an expansion device, a shutoff valve, a flow control valve) may be disposed along the suction conduit 150 between the first suction line 154 of the first compressor 138 and the second suction line 156 of the second compressor 140. The compressor system 134 includes a discharge conduit 160 that fluidly extends between corresponding discharge sides of the first and second compressors 138, 140 and the reversing valve 152. In this way, the first compressor 138 and the second compressor 140 may each be operable to draw (e.g., intake) a working fluid flow from the suction conduit 150 and discharge (e.g., output) the working fluid flow through the discharge conduit 160. More specifically, the first compressor 138 and the second compressor 140 may receive working fluid at different suction pressures, and the compressor system 134 may discharge working fluid at a common discharge pressure.

The suction conduit 150 may be fluidly coupled to the second flow path 124 of the subcooler 120, and the second flow path 124 of the subcooler 120 may be fluidly coupled to a subcooler inlet conduit 166 (e.g., a conduit branch, an inlet conduit). The subcooler inlet conduit 166 may be fluidly coupled to a conduit 168 (e.g., an intermediate conduit, a primary conduit, a primary conduit portion) of the working fluid circuit 108 (e.g., a primary circuit of the working fluid circuit 108) that extends between the first expansion valve 130 and the first flow path 122 of the subcooler 120 (e.g., between the first heat exchanger 104 and the second heat exchanger 108). A second control valve 170 (e.g., expansion valve) may be disposed along the subcooler inlet conduit 166 and, as discussed below, may be configured to regulate (e.g., throttle, enable, block) working fluid flow from the conduit 168 to the second flow path 124 of the subcooler 120.

The subcooler inlet conduit 166 may also direct a flow of working fluid (e.g., a second flow of working fluid) through the second flow path 124 of the subcooler 120. For example, the subcooler inlet conduit 166 may direct a second flow of working fluid to the second flow path 124 to place the second flow of working fluid in a counterflow arrangement with a flow of working fluid (e.g., a first flow of working fluid) directed through the first flow path 122 of the subcooler 120 via the conduit 168. However, it should be appreciated that the subcooler 120 may be fluidly coupled to the working fluid circuit 108 and/or the subcooler inlet conduit 166 in any suitable arrangement or configuration to enable heat exchange between the first flow of working fluid and the second flow of working fluid. In some embodiments, the subcooler 120 may be fluidly coupled to the working fluid circuit 108 and the subcooler inlet conduit 166 to selectively place the first flow of working fluid and the second flow of working fluid in a counterflow arrangement or in a parallel flow arrangement (e.g., based on an operating mode of the heat pump 102). For example, the subcooler 120, the working fluid circuit 108, and/or the subcooler inlet conduit 166 may include one or more components (e.g., conduit portions, valves, etc.) configured to enable the subcooler 120 to place the first flow of working fluid and the second flow of working fluid in a counterflow arrangement in one type of operating mode of the heat pump 102 (e.g., a cooling mode or a heating mode) and to enable the subcooler 120 to place the first flow of working fluid and the second flow of working fluid in a parallel flow arrangement in another, different type of operating mode of the heat pump 102 (e.g., a heating mode or cooling mode). A controller of the heat pump 102 (e.g., controller 220 discussed below) may be configured to adjust flow control components of the subcooler 120, the working fluid circuit 108 and/or the subcooler inlet conduit 166 to cause the subcooler 120 to direct the first flow of working fluid and the second flow of working fluid in a desired flow arrangement.

The reversing valve 152, the first and second expansion valves 130, 132, the first and second control valves 158, 170, and/or the compressors 136 may form a portion of and be collectively referred to herein as a working fluid flow regulation system 178 (e.g., a flow regulation system).

The reversing valve 152 may include a first port 180 that is fluidly coupled to the discharge conduit 160 and a second port 182 that is fluidly coupled to a conduit 184 extending to the first heat exchanger 104. The reversing valve 152 may also include a third port 186 that is fluidly coupled to the suction conduit 150 and a fourth port 188 that is fluidly coupled to a conduit 176 extending to the second heat exchanger 106.

The reversing valve 152 is configured to transition between a first configuration 190, in which the reversing valve 152 fluidly couples the first port 180 and the second port 182, and fluidly couples the third port 186 and the fourth port 168, and a second configuration 192 (FIG. 9), in which the reversing valve 152 fluidly couples the first port 180 and the fourth port 188, and fluidly couples the second port 182 and the third port 186. Accordingly, in the first configuration 190, the reversing valve 152 enables one or more of the compressors 136 to receive a flow of working fluid from the second heat exchanger 106 and/or the subcooler 120 and to discharge a flow of working fluid to the first heat exchanger 104. Conversely, in the second configuration 192, the reversing valve 152 enables the compressors 136 to receive a flow of working fluid from the first heat exchanger 104 and/or the subcooler 120 and to discharge a flow of working fluid to the second heat exchanger 106.

As discussed in detail below, while in the first configuration 190, the reversing valve 152 enables the heat pump 102 to operate in a heating mode, in which the second heat exchanger 106 absorbs thermal energy from the ambient environment 112 and the first heat exchanger 104 rejects the absorbed thermal energy (e.g., as absorbed from the ambient environment 112) to the thermal load 110 to heat the thermal load 110. Further, while in the second configuration 192, the reversing valve 152 enables the heat pump 102 to operate in a cooling mode, in which the first heat exchanger 104 absorbs thermal energy from the thermal load 110 (e.g., to cool the thermal load 110) and the second heat exchanger 106 rejects the absorbed thermal energy (e.g., as absorbed from the thermal load 110) to the ambient environment 112. As such, while the reversing valve 152 is in the first configuration 190, the compressor system 134 may direct a working fluid flow along at least a portion (e.g., the first heat exchanger 104, the second heat exchanger 106) of the working fluid circuit 108 in a first flow direction 200. While the reversing valve 152 is in the second configuration 192, the compressor system 134 may direct a working fluid flow along at least a portion (e.g., the first heat exchanger 104, the second heat exchanger 106) of the working fluid circuit 108 in a second flow direction 202, opposite the first flow direction 200.

The HVAC system 100 may include a controller 220 (e.g., a control system, a thermostat, a control panel) that is communicatively coupled to one or more components of the heat pump 102 and is configured to monitor, adjust, and/or otherwise control operation of the components of the heat pump 102. For example, one or more control transfer devices, such as wires, cables, wireless communication devices, and the like, may communicatively couple the compressors 136, the reversing valve 152, the first and/or second expansion valves 130, 132, the first and/or second control valves 158, 170, the first and/or second fans 116, 118, the control device 16 (e.g., a thermostat), and/or any other suitable components of the HVAC system 100 to the controller 220. That is, the compressors 136, the reversing valve 152, the first and/or second expansion valves 130, 132, the first and/or second control valves 158, 170, the first and/or second fans 116, 118, and/or the control device 16 may each have a communication component that facilitates wired or wireless (e.g., via a network) communication with the controller 220. In some embodiments, the communication components may include a network interface that enables the components of the HVAC system 100 to communicate via various protocols such as EtherNet/IP, ControlNet, DeviceNet, or any other communication network protocol. Alternatively, the communication component may enable the components of the HVAC system 100 to communicate via mobile telecommunications technology, Bluetooth®, near-field communications technology, and the like. As such, the compressors 136, the reversing valve 152, the first and/or second expansion valves 130, 132, the first and/or second control valves 158, 170, the first and/or second fans 116, 118, and/or the control device 16 (e.g., a thermostat) may wirelessly communicate data between each other.

In some embodiments, the controller 220 may include a portion or all of the control panel 82 or may be another suitable controller included in the HVAC system 100. In any case, the controller 220 may be used to control components of the HVAC system 100 in accordance with the techniques discussed herein. The controller 220 includes processing circuitry 222, such as one or more microprocessors, which may execute software for controlling the components of the HVAC system 100. The processing circuitry 222 may include multiple microprocessors, one or more "general-purpose" microprocessors, one or more special-purpose microprocessors, and/or one or more application specific integrated circuits (ASICS), or some combination thereof. For example, the processing circuitry 222 may include one or more reduced instruction set (RISC) processors.

The controller 220 may also include a memory device 224 (e.g., a memory) that may store information such as instructions, control software, look up tables, configuration data, etc. The memory device 224 may include a volatile memory, such as random access memory (RAM), and/or a nonvolatile memory, such as read-only memory (ROM). The memory device 224 may store a variety of information and may be used for various purposes. For example, the memory device 224 may store processor-executable instructions including firmware or software for the processing circuitry 222 execute, such as instructions for controlling components of the HVAC system 100. In some embodiments, the memory device 224 is a tangible, non-transitory, machine-readable-medium that may store machine-readable instructions for the processing circuitry 222 to execute. The memory device 224 may include ROM, flash memory, a hard drive, or any other suitable optical, magnetic, or solid-state storage medium, or a combination thereof. The memory device 224 may store data, instructions, and any other suitable data.

Figure 6:
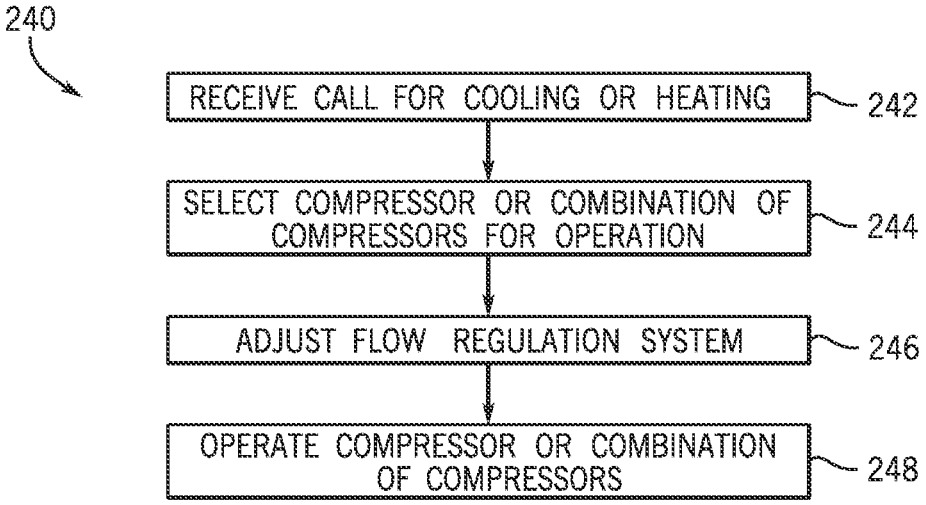
FIG. 6 is a flow diagram of an embodiment of a process for operating a heat pump system, in accordance with an aspect of the present disclosure.

To facilitate the following discussion, FIG. 6 is flow diagram of an embodiment of a process 240 for controlling the heat pump 102 in accordance with the presently disclosed techniques. FIG. 6 will be referenced concurrently with FIG. 5 throughout the following discussion. It should be noted that the steps of the process 240 discussed below may be performed in any suitable order and are not limited to the order shown in the illustrated embodiment of FIG. 6. Moreover, it should be noted that additional steps of the process 240 may be performed, and certain steps of the process 240 may be omitted. In some embodiments, the process 240 may be executed by the processing circuitry 222 of the controller 220 and/or any other suitable processing circuitry of the HVAC system 100. The process 240 may be stored (e.g., as executable instructions) on, for example, the memory 88 or the memory device 224.

The process 240 may begin with receiving a call for cooling or heating, as indicated by block 242. For example, the controller 220 may receive a call (e.g., a control instruction) from the control device 16 (e.g., a thermostat) or another suitable controller instructing the controller 220 to operate the heat pump 102 in the cooling mode to cool the thermal load 110 or in the heating mode to heat the thermal load 110. In response to receiving the call for cooling or heating, the controller 220 may select a corresponding compressor 136 or combination of compressors 136 to operate to satisfying a demand of the thermal load 110, as indicated by block 244. In other words, the controller 220 may select a particular operating mode of the heat pump 102 and may operate components of the heat pump 102 based on the selected operating mode. For example, the controller 220 may operate the first compressor 138 and stay (e.g., block) operation of the second compressor 140 in response to a first demand for conditioning (e.g., a low demand), operate the second compressor 140 and stay (e.g., block) operation of the first compressor 138 in response to a second demand for conditioning (e.g., a moderate demand, greater than the low demand), and operate both the first compressor 138 and the second compressor 140 in response to a third demand for conditioning (e.g., a high demand, greater than the moderate demand). As indicated by block 246, the controller 220 may adjust the working fluid flow regulation system 178 based on operational parameters of the HVAC system 100 (e.g., based on sensor feedback, based on a demand of the thermal load 110, based on user input) to enable enhanced heating and cooling operations of the heat pump 102 (e.g., with reduced energy consumption), as discussed below. Upon and/or during adjustment of the working fluid flow regulation system 178, the controller 220 may operate the selected compressor 136 or combination of compressors 136, as indicated by block 248.

In some embodiments, the controller 220 may be configured to operate the heat pump 102 in various heating modes and various cooling modes based on monitored operational parameters and/or user input (e.g., such as received via a user interface 230 communicatively coupled to the controller 220). For example, the controller 220 may be configured to operate the heat pump 102 based on a demand or load demand of the thermal load 110. As used herein, a "demand" or "load demand" (e.g., a conditioning demand level) may refer to an amount of conditioning (e.g., heating, cooling) called for (e.g., demanded) to condition the thermal load 110 (e.g., in accordance with a user input, to reach or achieve a set point temperature). An amount of conditioning demanded may be determined based on any suitable operating parameters and/or user input, such as a temperature indicative of a current or measured temperature of the thermal load 110 and a set point or target temperature. For example, the temperature indicative of the current or measured temperature may be detected by a sensor, and the set point temperature may be received from a user via the user interface 230 of the controller 220 and/or the control device 16 (e.g., thermostat). In some embodiments, a temperature differential between the current temperature of the thermal load 110 and the set point temperature may be representative or indicative of the amount of conditioning demanded, such as an amount of cooling demanded or an amount of heating demanded. For example, a "low demand" (e.g., a first threshold demand level or amount) may be associated with the temperature differential being below a first threshold amount (e.g., first threshold value), a "moderate demand" (e.g., a second threshold demand level or amount) may be associated with the temperature differential being above the first threshold amount and below a second threshold amount (e.g., a second threshold value), and a "high demand" (e.g., a third threshold demand level or amount) may be associated with the temperature differential being above the second threshold amount.

Similarly, the various operating modes of the heat pump 102 may be determined and selected based on a determination of the amount of conditioning demanded. For example, based on a determined load demand (e.g., heating load demand, cooling load demand), the controller 220 may be configured to operate the heat pump 102 in a low mode (e.g., low cooling mode, low heating mode), a moderate mode (e.g., moderate cooling mode, moderate heating mode), and/or a high mode (e.g., high cooing mode, high heating mode). In some instances, the low cooling mode and/or low heating mode may be associated with operation of the heat pump 102 at a first (e.g., low) operating capacity (e.g., heating capacity, cooling capacity), the moderate cooling mode and/or moderate heating mode may be associated with operation of the heat pump 102 at a second (e.g., moderate) operating capacity (e.g., greater than the first operating capacity), and the high cooling mode and/or high heating mode may be associated with operation of the heat pump 102 at a third (e.g., high) operating capacity (e.g., greater than the second operating capacity).

More specifically, the controller 220 may operate the heat pump 102 in a low heating mode in response to a determination that a heating demand of the thermal load 110 is relatively low (e.g., below a first threshold heating demand level), may operate the heat pump 102 in a moderate heating mode in response to a determination that the heating demand of the thermal load 110 is moderate (e.g., greater than a low heating demand, greater than the first threshold heating demand level), and may operate the heat pump 102 in a high heating mode in response to a determination that the heating demand of the thermal load 110 is relatively high (e.g., greater than a moderate heating demand, greater than a second threshold heating demand level that is greater than first threshold heating demand level). Moreover, the controller 220 may be configured to operate the heat pump 102 in a low cooling mode in response to a determination that a cooling demand of the thermal load 110 is relatively low (e.g., below a threshold cooling demand level), may operate the heat pump 102 in a moderate cooling mode in response to a determination that the cooling demand of the thermal load 110 is moderate (e.g., greater than a low cooling demand, greater than the first threshold cooling demand level), and may operate the heat pump 102 in a high cooling mode in response to a determination that the cooling demand of the thermal load 110 is relatively high (e.g., greater than a moderate cooling demand, greater than a second threshold cooling demand level that is greater than first threshold cooling demand level). As mentioned above, in some embodiments, the relative demand level (e.g., cooling demand level, heating demand level, conditioning demand level) of the thermal load 110 may be determined based on a temperature differential between a temperature indicative of a detected temperature of the thermal load 110 and a set point temperature (e.g., target temperature), which may be input by a user via the user interface 230, the control device 16, and so forth.

In some embodiments, the first compressor 138 may include operational characteristics (e.g., volume ratio, volume index, volume geometry, etc.) that are tailored (e.g., selected) to enhance operation of the heat pump 102 in certain heating and/or cooling modes of the heat pump 102 (e.g., the low heating mode, the low cooling mode). The second compressor 140 may include operational characteristics (e.g., volume ratio, volume index, volume geometry, etc.) that are tailored (e.g., selected) to enhance operation of the heat pump 102 in other heating and/or cooling modes of the heat pump 102 (e.g., the moderate heating mode, the moderate cooling mode). The operational characteristics of the compressors 136 may include respective volume indices or compression ratios of the compressors 136, respective capacities or displacements (e.g., swept volumes) of the compressors 136 (e.g., a volume of fluid ingested by the compressors 136 per revolution of the compressor 136), respective motor sizes (e.g., torque or power ranges) of motors of the compressors 136, and/or other suitable parameters of the compressors 136. In certain embodiments, the operational characteristics of the first compressor 138 and/or the second compressor 140 may be selected based on a climatic region (e.g., a geographical location) in which the heat pump 102 is implemented. Moreover, in embodiments where the first compressor 138 includes a compressor subsystem having one or more compressors 136, the second compressor 140 includes a compressor sub-system having one or more compressors 136, or both, it should be understood that each of the compressors 136 in the respective compressor sub-systems may be selected to enhance operation of the heat pump 102 in a particular mode (e.g., low heating, low cooling). Moreover, as discussed below, the controller 220 may selectively enable operation of the first compressor 138, the second compressor 140, or both, in a manner that enhances an operational efficiency and/or operational performance (e.g., capacity) of the heat pump 102 in certain modes (e.g., low heating, moderate heating, high heating, low cooling, moderate cooling, high cooling). Indeed, the compressors 136 may be selectively operated to enable reduced energy consumption of the heat pump 102 in the various operating modes of the heat pump 102.

For example, in the illustrated embodiment of FIG. 5, the heat pump 102 may be configured for operation in the low heating mode (e.g., a first heating mode). The heat pump 102 may be operated in the low heating mode when a heating demand of the thermal load 110 is relatively low, such as below a first threshold heating demand level or limit associated with operation of the heat pump 102 in the low heating mode. As mentioned above, a demand of the thermal load 110 may be determined based on a temperature differential between a temperature indicative of a detected temperature of the thermal load 110 and a set point temperature.

To operate the heat pump in the low heating mode, the controller 220 may transition the reversing valve 152 to (or retain the reversing valve 152 in) the first configuration 190, transition the first control valve 158 to (or retain the first control valve 158 in) an open configuration (e.g., a fully open configuration), transition the second control valve 170 to (or retain the second control valve 170 in) a closed configuration (e.g., a fully closed configuration), transition the first expansion valve 130 to (or retain the first expansion valve 130 in) an open configuration (e.g., a fully open configuration), and transition the second expansion valve 132 to (or retain the second expansion valve 132 in) a partially open configuration (e.g., a configuration that enables expansion of working fluid flow across the second expansion valve 132). Further, the controller 220 may send control instructions to operate the first compressor 138 and to suspend or stay (e.g., block) operation of the second compressor 140. In some embodiments, a capacity (e.g., a volume index or compression ratio, a power output rating, an operating capacity) of the first compressor 138 may be less than a capacity (e.g., a volume index or compression ratio, a power output rating, an operating capacity) of the second compressor 140. In this way, the controller 220 may operate the first compressor 138 to draw working fluid from the suction conduit 150 (e.g., from the second heat exchanger 106) and to direct heated working fluid through the first heat exchanger 104 in the first flow direction 200 to enable the first heat exchanger 104 to reject heat to the thermal load 110 at a relatively low heat transfer rate. That is, the controller 220 may operate the first compressor 138, which may be selected and/or designed for low-load operations of the heat pump 102 (e.g., in the low heating mode), to circulate working fluid through the working fluid circuit 108 to enable operation of the heat pump 102 in the low heating mode. In some embodiments, because the controller 220 may transition the second control valve 170 to the closed position in the low heating mode, the first compressor 138 may not draw working fluid through the second flow path 124 of the subcooler 120 while the controller 220 operates the heat pump 102 in the low heating mode.

Figure 7:
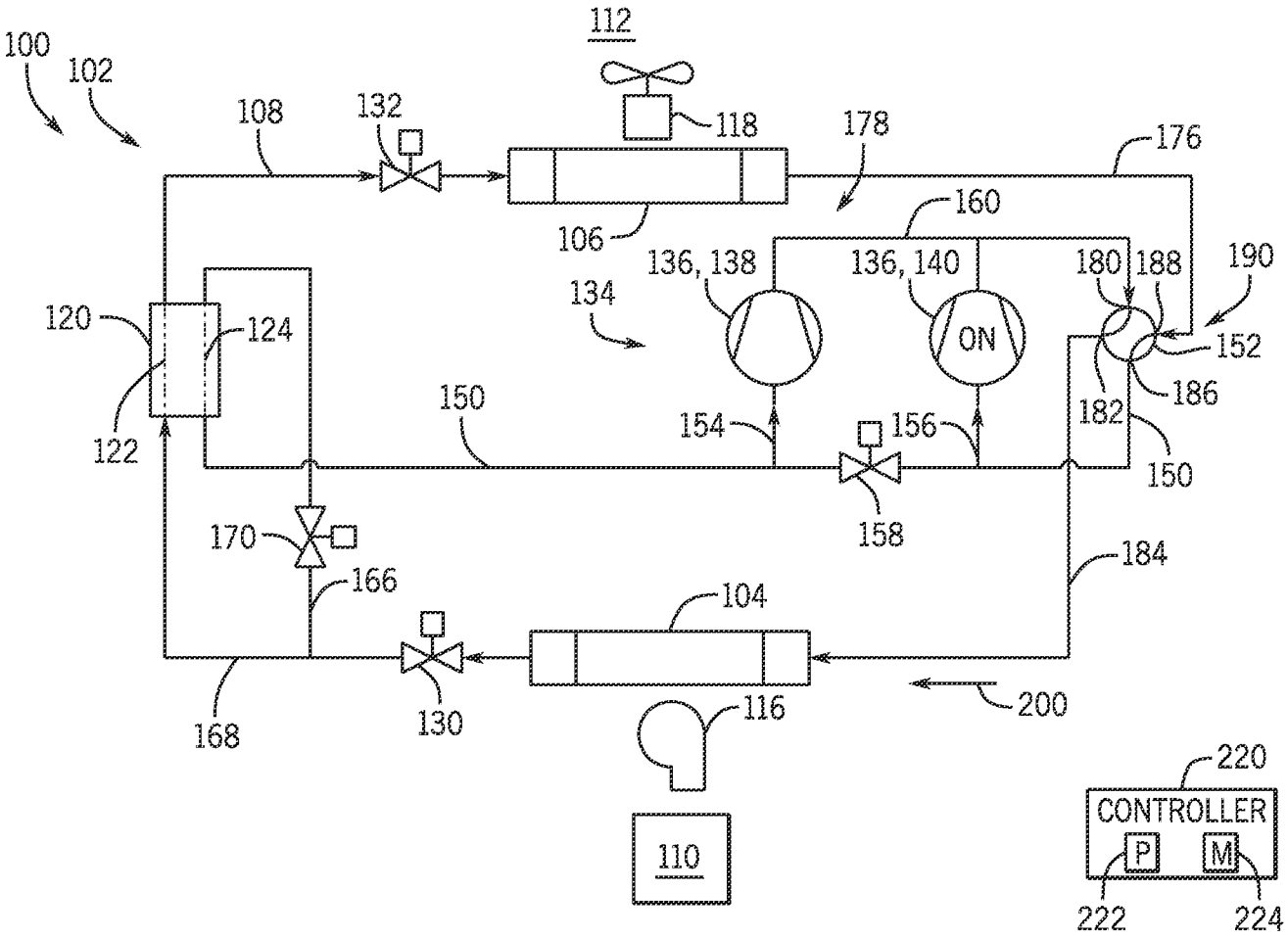
FIG. 7 is a schematic diagram of an embodiment of a portion of an HVAC system that includes a heat pump system configured for operation in a moderate heating mode, in accordance with an aspect of the present disclosure.

FIG. 7 is a schematic of an embodiment of a portion of the HVAC system 100 illustrating the heat pump 102 configured for operation in the moderate heating mode (e.g., a second heating mode). The heat pump 102 may be operated in the moderate heating mode (e.g., instead of the low heating mode) when a heating demand of the thermal load 110 is greater, such as above the first threshold heating demand level or limit associated with operation of the heat pump 102 in the low heating mode.

To operate the heat pump in the moderate heating mode, the controller 220 may transition the reversing valve 152 to (or retain the reversing valve 152 in) the first configuration 190, transition the first control valve 158 to (or retain the first control valve 158 in) an open configuration (e.g., a fully open configuration), transition the second control valve 170 to (or retain the second control valve 170 in) a closed configuration (e.g., a fully closed configuration), transition the first expansion valve 130 to (or retain the first expansion valve 130 in) an open configuration (e.g., a fully open configuration), and transition the second expansion valve 132 to (or retain the second expansion valve 132 in) a partially open configuration (e.g., a configuration that enables expansion of working fluid flow across the second expansion valve 132). Further, the controller 220 may send control instructions to operate the second compressor 140 and to suspend or stay (e.g., block) operation of the first compressor 138. In this way, the controller 220 may operate the second compressor 140 to draw working fluid from the suction conduit 150 (e.g., from the second heat exchanger 106) and to direct heated working fluid through the first heat exchanger 104 in the first flow direction 200 to enable the first heat exchanger 104 to reject heat to the thermal load 110 at a moderate heat transfer rate (e.g., greater than the low heat transfer rate discussed above). As discussed above, the capacity of the second compressor 140 may be greater than the capacity of the first compressor 138. As such, by operating the second compressor 140 instead of the first compressor 138 in the moderate heating mode, the heat pump 102 may increase working fluid flow circulation through the first heat exchanger 104 and, therefore, increase a rate of heat rejection from the first heat exchanger 104 to the thermal load 110. Because the controller 220 may transition the second control valve 170 to the closed position in the moderate heating mode, the second compressor 140 may not draw working fluid through the second flow path 124 of the subcooler 120 while the controller 220 operates the heat pump 102 in the moderate heating mode. In some embodiments, the controller 220 may increase operation speeds of the first fan 116, the second fan 118, or both (e.g., as compared to respective speeds of the first and/or second fans 116, 118 in the low heating mode) while operating the heat pump 102 in the moderate heating mode.

Figure 8:
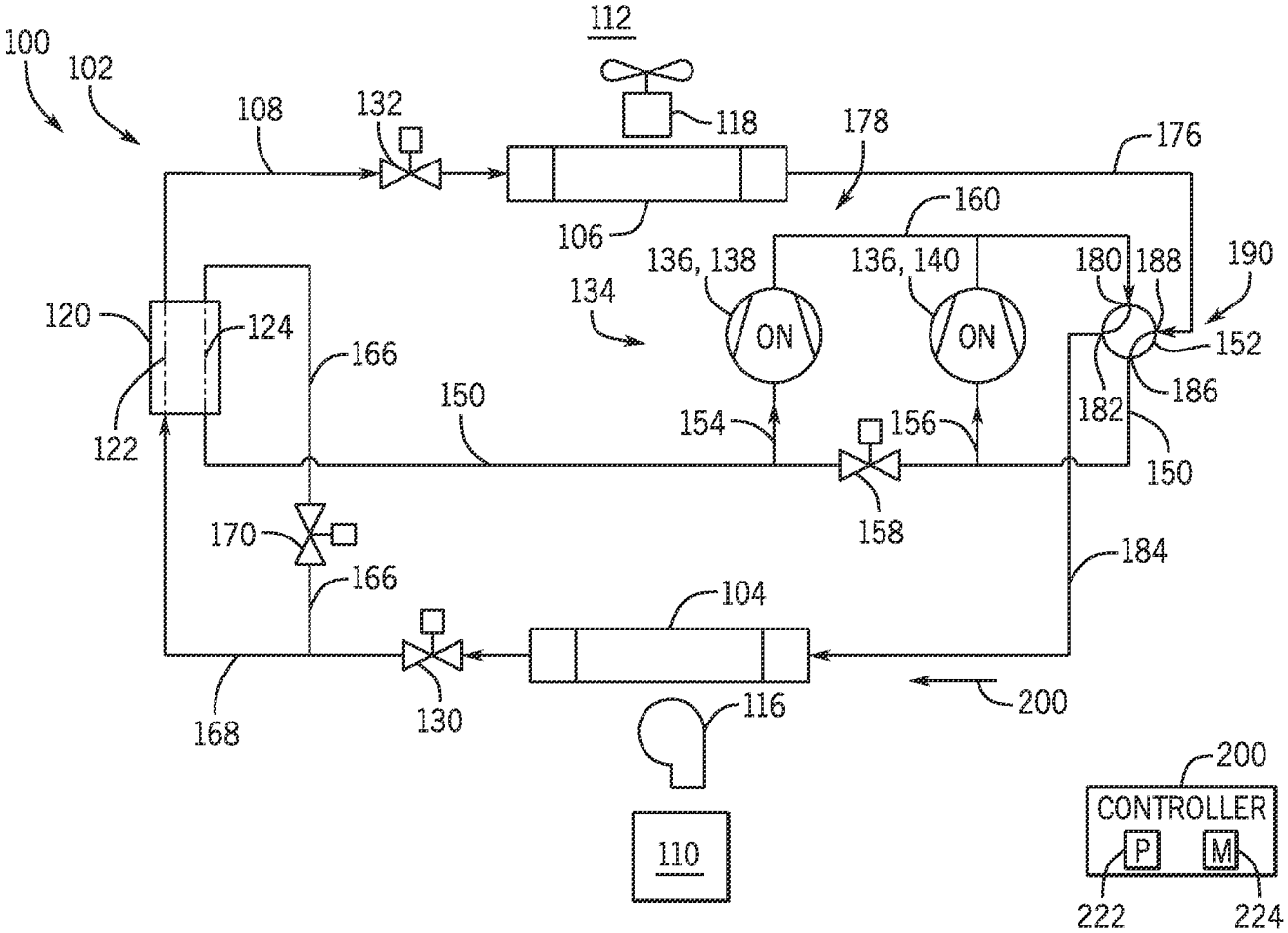
FIG. 8 is a schematic diagram of an embodiment of a portion of an HVAC system that includes a heat pump system configured for operation in a high heating mode, in accordance with an aspect of the present disclosure.

FIG. 8 is a schematic of an embodiment of a portion of the HVAC system 100 illustrating the heat pump 102 configured for operation in the high heating mode (e.g., a third heating mode). The heat pump 102 may be operated in the high heating mode (e.g., instead of the low heating mode or the moderate heating mode) when a heating demand of the thermal load 110 is greater, such as above a second threshold heating demand level or limit associated with operation of the heat pump 102 in the moderate heating mode.

To operate the heat pump 102 in the high heating mode, the controller 220 may transition the reversing valve 152 to (or retain the reversing valve 152 in) the first configuration 190, transition the first control valve 158 to (or retain the first control valve 158 in) a partially open configuration (e.g., a configuration that restricts and enables working fluid flow across the first control valve 158) or a fully closed configuration, transition the second control valve 170 to (or retain the second control valve 170 in) an open configuration (e.g., a partially open configuration, a fully open configuration), transition the first expansion valve 130 to (or retain the first expansion valve 130 in) an open configuration (e.g., a fully open configuration), and transition the second expansion valve 132 to (or retain the second expansion valve 132 in) a partially open configuration (e.g., a configuration that enables expansion of working fluid flow across the second expansion valve 132). Further, the controller 220 may send control instructions to operate the first compressor 138 and the second compressor 140. In this way, the controller 220 may operate the first compressor 138 to draw working fluid from the second flow path 124 of the subcooler 120 and operate the second compressor 140 to draw working fluid from the suction conduit 150 (e.g., from the second heat exchanger 106) and/or from the second flow path 124 of the subcooler 120. The first and second compressors 138, 140 may direct heated working fluid through the first heat exchanger 104 in the first flow direction 200 to enable the first heat exchanger 104 to reject heat to the thermal load 110 at a relatively high heat transfer rate (e.g., greater than the moderate heat transfer rate discussed above).

By restricting working fluid flow along the suction conduit 150, the first control valve 158 may enable a suction pressure of the second compressor 140 to be different than a suction pressure of the first compressor 138. The compressor system 134 may discharge working fluid at a common discharge pressure. Because the controller 220 may transition the second control valve 170 to the partially open or fully open position in the high heating mode, the first compressor 138 and/or the second compressor 140 may draw working fluid through the second flow path 124 of the subcooler 120 while the controller 220 operates the heat pump 102 in the high heating mode. The second control valve 170 may expand working fluid flowing from the first heat exchanger 104 to the second flow path 124, prior the working fluid entering the second flow path 124, such that a temperature of working fluid flowing through the second flow path 124 is less than a temperature of working fluid flowing through the first flow path 122 of the subcooler 120. As such, the subcooler 120 may enable working fluid flowing through the second flow path 124 to cool working fluid flowing through the first flow path 122 and toward the second heat exchanger 106, which may improve an overall operational efficiency of the heat pump 102. In some embodiments, the controller 220 may increase operation speeds of the first fan 116, the second fan 118, or both (e.g., as compared to respective speeds of the first and/or second fans 116, 118 in the moderate heating mode) while operating the heat pump 102 in the high heating mode.

Figure 9:
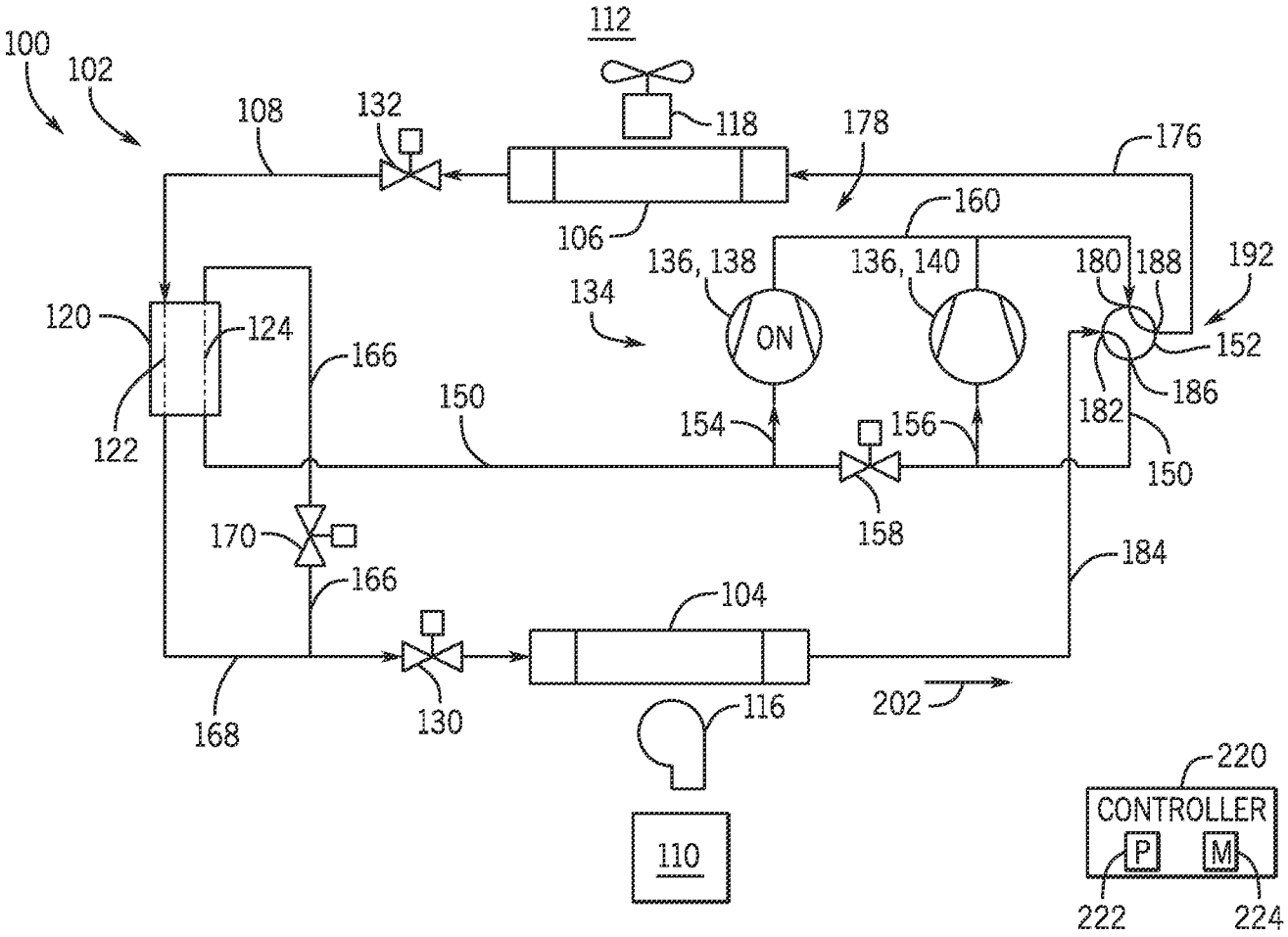
FIG. 9 is a schematic diagram of an embodiment of a portion of an HVAC system that includes a heat pump system configured for operation in a low cooling mode, in accordance with an aspect of the present disclosure.

FIG. 9 is a schematic of an embodiment of a portion of the HVAC system 100 illustrating the heat pump 102 configured for operation in the low cooling mode (e.g., a first cooling mode). The heat pump 102 may be operated in the low cooling mode when a cooling demand of the thermal load 110 is relatively low, such as below a first threshold cooling demand level or limit associated with operation of the heat pump 102 in the low cooling mode.

To operate the heat pump in the low cooling mode, the controller 220 may transition the reversing valve 152 to (or retain the reversing valve 152 in) the second configuration 192, transition the first control valve 158 to (or retain the first control valve 158 in) an open configuration (e.g., a fully open configuration), transition the second control valve 170 to (or retain the second control valve 170 in) a closed configuration (e.g., a fully closed configuration), transition the first expansion valve 130 to (or retain the first expansion valve 130 in) a partially open configuration (e.g., a configuration that enables expansion of working fluid flow across the first expansion valve 130), and transition the second expansion valve 132 to (or retain the second expansion valve 132 in) an open configuration (e.g., a fully open configuration). Further, the controller 220 may send control instructions to operate the first compressor 138 and to suspend or stay (e.g., block) operation of the second compressor 140. In this way, the controller 220 may operate the first compressor 138 to draw working fluid from the suction conduit 150 (e.g., from the first heat exchanger 104) and to direct heated working fluid through the second heat exchanger 106 in the second flow direction 202 to enable the first heat exchanger 104 to absorb heat from the thermal load 110 at a relatively low heat transfer rate. That is, as the capacity of the first compressor 138 may be less than a capacity of the second compressor 140, the controller 220 may operate the first compressor 138 (e.g., which may be selected or designed for cooling operations of the heat pump 102 in low-load conditions), to circulate working fluid through the working fluid circuit 108 to enable operation of the heat pump 102 in the low cooling mode with improved efficiency (e.g., reduced energy consumption). In some embodiments, because the controller 220 may transition the second control valve 170 to the closed position in the low cooling mode, the first compressor 138 may not draw working fluid through the second flow path 124 of the subcooler 120 while the controller 220 operates the heat pump 102 in the low cooling mode.

Figure 10:
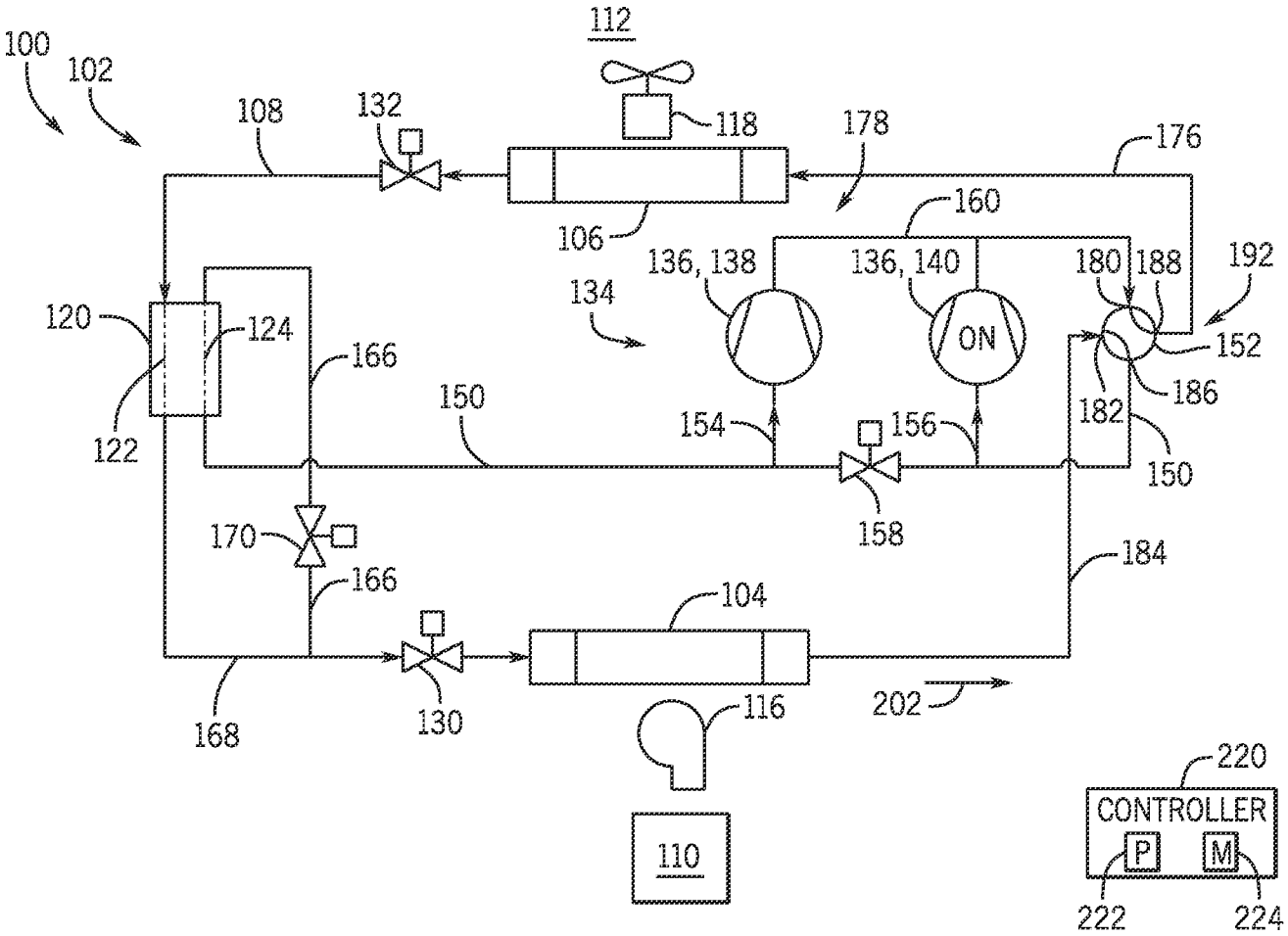
FIG. 10 is a schematic diagram of an embodiment of a portion of an HVAC system that includes a heat pump system configured for operation in a moderate cooling mode, in accordance with an aspect of the present disclosure.

FIG. 10 is a schematic of an embodiment of a portion of the HVAC system 100 illustrating the heat pump 102 configured for operation in the moderate cooling mode (e.g., a second cooling mode). The heat pump 102 may be operated in the moderate cooling mode (e.g., instead of the low cooling mode) when a cooling demand of the thermal load 110 is greater, such as above the first threshold cooling demand level or limit associated with operation of the heat pump 102 in the low cooling mode.

To operate the heat pump in the moderate cooling mode, the controller 220 may transition the reversing valve 152 to (or retain the reversing valve 152 in) the second configuration 192, transition the first control valve 158 to (or retain the first control valve 158 in) an open configuration (e.g., a fully open configuration) or a closed configuration (e.g., a fully closed configuration), transition the second control valve 170 to (or retain the second control valve 170 in) a closed configuration (e.g., a fully closed configuration), transition the first expansion valve 130 to (or retain the first expansion valve 130 in) a partially open configuration (e.g., a configuration that enables expansion of working fluid flow across the first expansion valve 130), and transition the second expansion valve 132 to (or retain the second expansion valve 132 in) an open configuration (e.g., a fully open configuration). Further, the controller 220 may send control instructions to operate the second compressor 140 and to suspend or stay (e.g., block) operation of the first compressor 138. In this way, the controller 220 may operate the second compressor 140 to draw working fluid from the suction conduit 150 (e.g., from the first heat exchanger 104) and to direct heated working fluid through the second heat exchanger 106 in the second flow direction 202 to enable the first heat exchanger 104 to absorb heat from the thermal load 110 at a moderate heat transfer rate.

As noted above, because the capacity of the second compressor 140 may be greater than the capacity of the first compressor 138, by operating the second compressor 140 instead of the first compressor 138 in the moderate cooling mode, the controller 220 may increase working fluid flow circulation through the first heat exchanger 104 and, therefore, increase a rate at which the first heat exchanger 104 absorbs thermal energy from the thermal load 110. Because the controller 220 may transition the second control valve 170 to the closed position in the moderate cooling mode, the second compressor 140 may not draw working fluid through the second flow path 124 of the subcooler 120 while the controller 220 operates the heat pump 102 in the moderate cooling mode. In some embodiments, the controller 220 may increase operation speeds of the first fan 116, the second fan 118, or both (e.g., as compared to respective speeds of the first and/or second fans 116, 118 in the low cooling mode) while operating the heat pump 102 in the moderate cooling mode.

Figure 11:
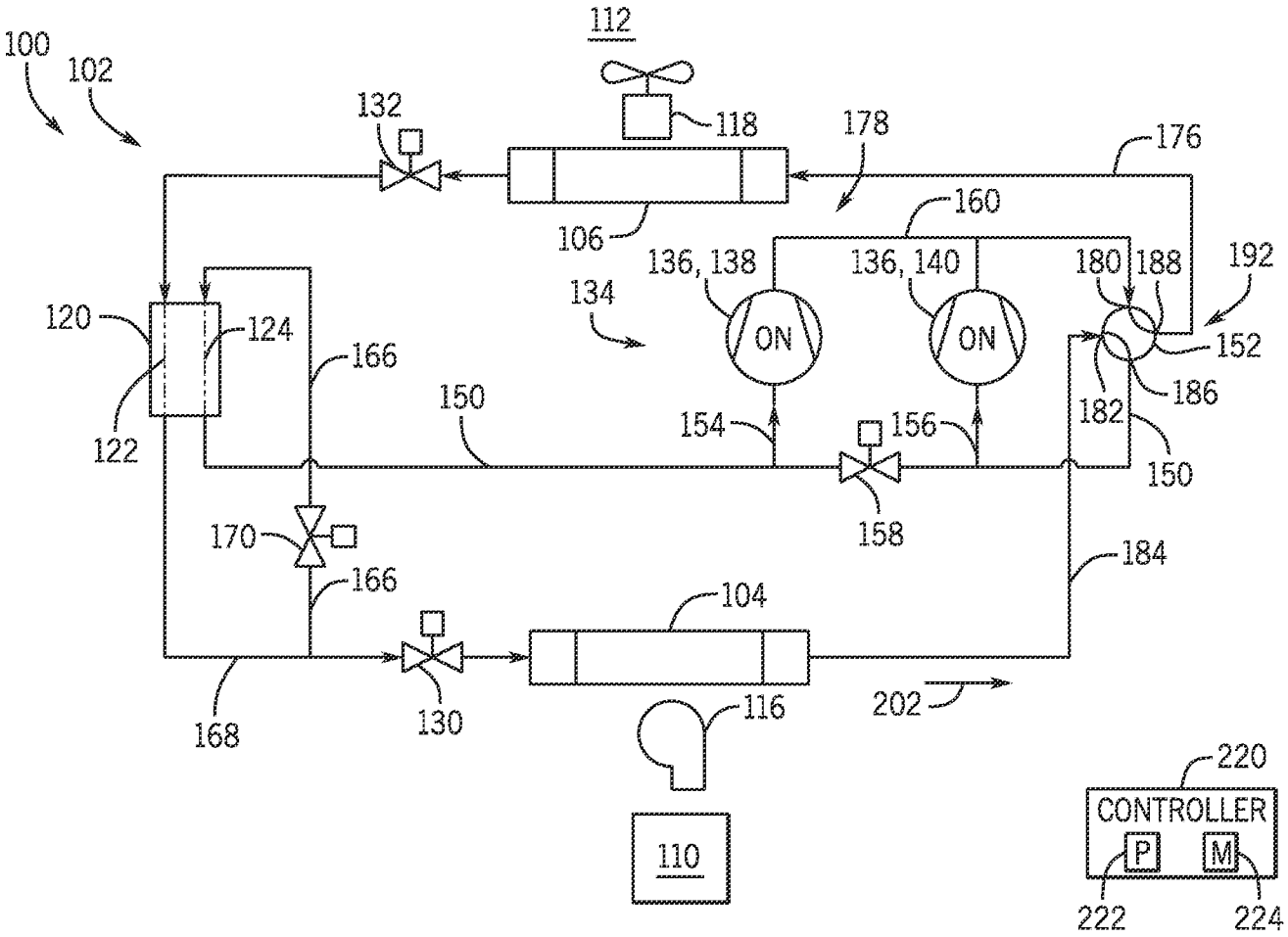
FIG. 11 is a schematic diagram of an embodiment of a portion of an HVAC system that includes a heat pump system configured for operation in a high cooling mode, in accordance with an aspect of the present disclosure.

FIG. 11 is a schematic of an embodiment of a portion of the HVAC system 100 illustrating the heat pump 102 configured for operation in the high cooling mode (e.g., a third cooling mode). The heat pump 102 may be operated in the high cooling mode (e.g., instead of the low cooling mode or the moderate cooling mode) when a cooling demand of the thermal load 110 is greater, such as above a second threshold cooling demand level or limit associated with operation of the heat pump 102 in the moderate cooling mode.

To operate the heat pump 102 in the high cooling mode, the controller 220 may transition the reversing valve 152 to (or retain the reversing valve 152 in) the second configuration 192, transition the first control valve 158 to (or retain the first control vale 158 in) a partially open configuration (e.g., a configuration that restricts and enables working fluid flow across the first control valve 158) or a fully open configuration, transition the second control valve 170 to (or retain the second control valve 170 in) an open configuration (e.g., a partially open configuration, a fully open configuration) or in a closed configuration. The controller 220 may also transition the first expansion valve 130 to (or retain the first expansion valve 130 in) a partially open configuration (e.g., a configuration that enables expansion of working fluid flow across the first expansion valve 130) and transition the second expansion valve 132 to (or retain the second expansion valve 132 in) an open configuration (e.g., a fully open configuration). Further, the controller 220 may send control instructions to operate the first compressor 138 and the second compressor 140. In this way, the controller 220 may operate the first compressor 138 to draw working fluid from the second flow path 124 of the subcooler 120 and operate the second compressor 140 to draw working fluid from the suction conduit 150 (e.g., from the first heat exchanger 104) and/or from the second flow path 124 of the subcooler 120 (e.g., with the second control valve 170 at least partially open). The first and second compressors 138, 140 may direct cooled working fluid through the first heat exchanger 104 in the second flow direction 202 to enable the first heat exchanger 104 to absorb thermal energy from the thermal load 110 at a relatively high heat transfer rate. By restricting working fluid flow along the suction conduit 150, the first control valve 158 may enable a suction pressure of the second compressor 140 to be different than a suction pressure of the first compressor 138 and enable the compressor system 134 to output working fluid at a common discharge pressure.

Because the controller 220 may transition the second control valve 170 to the partially open or fully open position in the high cooling mode (e.g., in an efficiency cooling mode), the first compressor 138 and/or the second compressor 140 may draw working fluid through the second flow path 124 of the subcooler 120 while the controller 220 operates the heat pump 102 in the high cooling mode (e.g., efficiency cooling mode). The second control valve 170 may expand working fluid flowing from the subcooler inlet conduit 166 to the second flow path 124, prior the working fluid entering the second flow path 124, such that a temperature of working fluid flowing through the second flow path 124 is less than a temperature of working fluid flowing through the first flow path 122. As such, the subcooler 120 may enable working fluid flowing through the second flow path 124 to cool working fluid flowing through the first flow path 122 and toward the first heat exchanger 104, which may improve an overall operational efficiency of the heat pump 102 (e.g., reduced energy consumption, increased heat transfer efficiency). In some embodiments, the controller 220 may increase operation speeds of the first fan 116, the second fan 118, or both (e.g., as compared to respective speeds of the first and/or second fans 116, 118 in the moderate cooling mode) while operating the heat pump 102 in the high cooling mode.

As set forth above, embodiments of the present disclosure may provide one or more technical effects useful for adjusting compression and/or circulation of working fluid along a working fluid circuit of a heat pump, based on one or more operational parameters, modes, and/or characteristics of the heat pump. As such, implementation of the disclosed heat pump system may improve an overall operational efficiency of an HVAC system during cooling and heating operations. That is, the disclosed techniques may improve an overall operational efficiency of an HVAC system during cooling and heating operations, such as improved heat transfer efficiency, improved energy efficiency, and/or reduced energy consumption. Indeed, the HVAC systems disclosed herein are configured to operate with reduced greenhouse gas emissions by operating to heat and cool an air flow in an energy efficient manner and without operation of a furnace or other system that consumes a fuel. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An energy efficient heat pump for a heating, ventilation, and air conditioning (HVAC) system, comprising:

a compressor system comprising a plurality of compressors configured to direct a working fluid along a working fluid circuit of the heat pump;

a suction conduit configured to direct the working fluid to the plurality of compressors;

a first suction conduit portion extending from the suction conduit to a first compressor of the plurality of compressors;

a second suction conduit portion extending from the suction conduit to a second compressor of the plurality of compressors; and a control valve disposed along the suction conduit between the first suction conduit portion and the second suction conduit portion.

2. The energy efficient heat pump of claim 1, comprising a controller communicatively coupled to the compressor system, wherein the controller is configured to:

operate the first compressor and stay operation of the second compressor to operate the heat pump in response to a first conditioning demand level;

operate the second compressor and stay operation of the first compressor to operate the heat pump in response to a second conditioning demand level greater than the first conditioning demand level; and operate the first compressor and operate the second compressor to operate the heat pump in response to a third conditioning demand level greater than the second conditioning demand level.

3. The energy efficient heat pump of claim 2, wherein the first compressor comprises a first volume index, and the second compressor comprises a second volume index different from the first volume index.

4. The energy efficient heat pump of claim 3, wherein the first volume index is less than the second volume index.

5. The energy efficient heat pump of claim 1, comprising:

the working fluid circuit, wherein the compressor system is disposed along the working fluid circuit;

a first heat exchanger disposed along the working fluid circuit, wherein the first heat exchanger is configured to place the working fluid in a heat exchange relationship with a supply air flow;

a second heat exchanger disposed along the working fluid circuit, wherein the second heat exchanger is configured to place the working fluid in a heat exchange relationship with an ambient air flow; and an intermediate heat exchanger disposed along the working fluid circuit, wherein the suction conduit extends from the control valve to the intermediate heat exchanger.

6. The energy efficient heat pump of claim 5, comprising a reversing valve disposed along the working fluid circuit, wherein the reversing valve is configured to adjust a flow direction of the working fluid along the working fluid circuit, and wherein the suction conduit extends from the control valve to the reversing valve.

7. The energy efficient heat pump of claim 5, wherein the intermediate heat exchanger comprises a first flow path and a second flow path, the heat pump comprises an inlet conduit extending from the working fluid circuit to the second flow path, the suction conduit extends from the second flow path to the control valve, the working fluid circuit is configured to direct a first flow of the working fluid through the first flow path, the inlet conduit is configured direct a second flow of the working fluid from the working fluid circuit to the second flow path, and the intermediate heat exchanger is configured to place the first flow of the working fluid in a heat exchange relationship with the second flow of the working fluid.

8. The energy efficient heat pump of claim 7, wherein the control valve is a first control valve, and the heat pump comprises a second control valve disposed along the inlet conduit between the working fluid circuit and the intermediate heat exchanger.

9. The energy efficient heat pump of claim 8, wherein the second control valve is configured to reduce a pressure of the second flow of the working fluid directed to the second flow path, reduce a temperature of the second flow of the working fluid directed to the second flow path, or both.

10. An energy efficient heat pump for a heating, ventilation, and air conditioning (HVAC) system, comprising:

a working fluid circuit configured to circulate a working fluid therethrough, wherein the working fluid circuit comprises a first heat exchanger configured to exchange heat between the working fluid and a supply air flow, a second heat exchanger configured to exchange heat between the working fluid and an ambient air flow, and an intermediate heat exchanger configured to exchange heat between a first flow of the working fluid and a second flow of the working fluid; and a flow regulation system, comprising:

a reversing valve disposed along the working fluid circuit and configured to adjust a flow direction of the working fluid through the working fluid circuit;

a first compressor and a second compressor disposed along the working fluid circuit and arranged in a parallel flow arrangement; and a flow control valve disposed along a suction conduit extending between the reversing valve and the intermediate heat exchanger, wherein the flow control valve is disposed between a first conduit configured to direct the working fluid from the suction conduit to the first compressor and a second conduit configured to direct the working fluid from the suction conduit to the second compressor.

11. The energy efficient heat pump of claim 10, comprising a controller configured to adjust a position of the flow control valve based on a load demand of the heat pump.

12. The energy efficient heat pump of claim 10, wherein the working fluid circuit comprises a primary conduit portion extending between the first heat exchanger and the intermediate heat exchanger, and the heat pump comprises an inlet conduit extending from the primary conduit portion to the intermediate heat exchanger, wherein the primary conduit portion is configured to direct the first flow of the working fluid to a first flow path of the intermediate heat exchanger, and the inlet conduit is configured to direct the second flow of the working fluid to a second flow path of the intermediate heat exchanger.

13. The energy efficient heat pump of claim 12, wherein the flow control valve is a first control valve, and the heat pump comprises a second control valve disposed along the inlet conduit, wherein the second control valve is configured to reduce temperature and pressure of the second flow of the working fluid directed to the second flow path of the intermediate heat exchanger.

14. The energy efficient heat pump of claim 10, wherein the first compressor comprises a first volume index, the second compressor comprises a second volume index different from the first volume index, and the heat pump comprises a controller communicatively coupled to the first compressor and the second compressor, wherein the controller is configured to:

operate the first compressor and stay operation of the second compressor in response to a determination that a load demand of the heat pump is below a threshold demand level; and operate the second compressor in response to a determination that the load demand of the heat pump is above the threshold demand level.

15. The energy efficient heat pump of claim 14, where the controller is configured to:

operate the second compressor and stay operation of the first compressor in response to a determination that the load demand of the heat pump is above the threshold demand level and is below an additional threshold demand level, wherein the additional threshold demand level is greater than the threshold demand level; and operate the first compressor and operate the second compressor in response to a determination that the load demand of the heat pump is above the additional threshold demand level.

16. The energy efficient heat pump of claim 15, wherein the controller is configured to adjust the flow control valve to a fully open position in response to a determination that the load demand of the heat pump is below the additional threshold demand level.

17. An energy efficient heat pump for a heating, ventilation, and air conditioning (HVAC) system, comprising:

a working fluid circuit configured to circulate a working fluid;

a first compressor and a second compressor disposed along the working fluid circuit and arranged in a parallel flow arrangement, wherein the first compressor and the second compressor are configured to receive the working fluid via a suction conduit of the working fluid circuit, wherein the first compressor comprises a first volume index, the second compressor comprises a second volume index, and the first volume index and the second volume index are different from one another;

a flow control valve disposed along the suction conduit between a first suction inlet of the first compressor and a second suction inlet of the second compressor; and a controller communicatively coupled to the flow control valve, wherein the controller is configured to adjust a position of the flow control valve based on a load demand of the heat pump.

18. The energy efficient heat pump of claim 17, wherein the controller is configured to:

operate the first compressor and stay operation of the second compressor in response to a determination that the load demand is below a first threshold demand;

operate the second compressor and stay operation of the first compressor in response to a determination that the load demand is above the first threshold demand and below a second threshold demand, wherein the second threshold demand is greater than the first threshold demand; and operate the first compressor and operate the second compressor in response to a determination that the load demand is greater than the second threshold demand.

19. The energy efficient heat pump of claim 17, comprising:

a first heat exchanger disposed along the working fluid circuit, wherein the first heat exchanger is configured to place the working fluid in a heat exchange relationship with a supply air flow;

a second heat exchanger disposed along the working fluid circuit, wherein the second heat exchanger is configured to place the working fluid in a heat exchange relationship with an ambient air flow;

a reversing valve disposed along the working fluid circuit, wherein the reversing valve is configured to adjust a flow direction of the working fluid through the working fluid circuit; and an intermediate heat exchanger disposed along the working fluid circuit, wherein the suction conduit extends from the reversing valve to the intermediate heat exchanger.

20. The energy efficient heat pump of claim 19, wherein the intermediate heat exchanger comprises a first flow path and a second flow path, the heat pump comprises an inlet conduit extending from the working fluid circuit to the second flow path, the suction conduit is fluidly coupled to the second flow path, the working fluid circuit is configured to direct a first flow of the working fluid through the first flow path, the inlet conduit is configured direct a second flow of the working fluid from the working fluid circuit to the second flow path, and the intermediate heat exchanger is configured to place the first flow of the working fluid in a heat exchange relationship with the second flow of the working fluid.

* * * * *